US007581673B2

(12) United States Patent
Elliston

(10) Patent No.: US 7,581,673 B2
(45) Date of Patent: Sep. 1, 2009

(54) CONTAINER WITH RECLOSABLE POUR SPOUT

(75) Inventor: George E. Elliston, La Grange, GA (US)

(73) Assignee: International Paper Company, Memphis, TN (US)

( * ) Notice: Subject to any disclaimer, the term of this patent is extended or adjusted under 35 U.S.C. 154(b) by 0 days.

(21) Appl. No.: 11/881,116

(22) Filed: Jul. 25, 2007

(65) Prior Publication Data

US 2009/0026252 A1 Jan. 29, 2009

(51) Int. Cl.
*B65D 5/72* (2006.01)

(52) U.S. Cl. ..... 229/215; 229/217

(58) Field of Classification Search ..... 229/215, 229/217, 219

See application file for complete search history.

(56) References Cited

U.S. PATENT DOCUMENTS 1,837,750 A * 12/1931 Becker ..... 229/219
2,029,747 A * 2/1936 Venning et al. ..... 229/215
2,819,831 A 1/1958 Polarek et al.
3,344,972 A 10/1967 Robinson et al.
4,168,003 A * 9/1979 Wysocki ..... 229/217
5,000,320 A 3/1991 Kuchenbecker
5,036,983 A 8/1991 Thykeson
5,114,013 A 5/1992 Brown et al.
5,452,850 A * 9/1995 Allsop ..... 229/219
5,531,376 A 7/1996 Brink et al.
5,582,344 A * 12/1996 Lawson et al. ..... 229/217
5,660,324 A * 8/1997 Rowland ..... 229/215
5,746,370 A * 5/1998 Stone ..... 229/217
5,810,250 A 9/1998 Stone et al.
2007/0131752 A1 * 6/2007 Jones ..... 229/215

* cited by examiner

*Primary Examiner*—Gary E Elkins
(74) *Attorney, Agent, or Firm*—Matthew M. Eslami

(57) ABSTRACT

The present invention relates to a container comprising opposing top and bottom walls and four side walls each having an upper and lower ends, the opposing top and bottom walls and the four side walls bridging the opposing top and bottom walls. The top wall comprises a pivotable tab integrally extending from one transverse end of the top wall. A generally U-shaped indentation is formed on one of the four side walls to receive the pivotable tab therein. A dispensing opening is configured on the upper end of one of the four side walls. The dispensing opening and the pivotable tab cooperate with one another to define a pour spout. The pivotable tab is seated in the U-shaped indentation to cover the dispensing opening when the pour spout is in a closed position and the pivotable tab is detached from the dispensing opening when the pour spout is an open position.

3 Claims, 5 Drawing Sheets

CONTAINER WITH RECLOSABLE POUR SPOUT

FIELD OF THE INVENTION

The present invention relates generally to containers or cartons and more particularly, to a paperboard container or cartons including an integrally formed paperboard pour spout.

BACKGROUND OF THE INVENTION

Conventional foldable cartons are well known and are used in a variety of applications. For example, the packaging industry utilizes a vast number of cartons in which numerous products are packaged for subsequent shipment. Current cartons used for packaging flowable substance require forming machinery that has expensive tooling that must be changed for each size package. Also, a variety of cartons includes one or more metal or plastic pour spouts to aid in dispensing, draining or straining liquid contained in the carton or container. The usage of metal or plastic pour spouts in cartons is costly for the pour spout requires special and expensive application equipment and cause decreased assembly line efficiencies. The present invention eliminates the expensive tooling that is needed to form conventional packaging and also provides a pour spout that is integrally formed with the cartons.

SUMMARY OF THE INVENTION

The present invention relates to a container comprising a pour spout to aid in dispensing, draining or straining flowable substance contained in the carton or container.

Accordingly, one aspect of the present invention relates to The present invention relates to a container comprising opposing top and bottom walls and four side walls each having an upper and lower ends, the opposing top and bottom walls and the four side walls bridging the opposing top and bottom walls. The top wall comprises a pivotable tab integrally extending from one transverse end of the top wall. A generally U-shaped indentation is formed on one of the four side walls to receive the pivotable tab therein. A dispensing opening is configured on the upper end of one of the four side walls. The dispensing opening and the pivotable tab cooperate with one another to define a pour spout. The pivotable tab is seated in the U-shaped indentation to cover the dispensing opening when the pour spout is in a closed position and the pivotable tab is detached from the dispensing opening when the pour spout is an open position.

Another aspect of the present invention relates a container comprising opposing top and bottom walls, opposing end walls, and opposing side walls. The opposing top and bottom walls are spaced apart from one another by the opposing end walls and the opposing side walls. The opposing top and bottom walls are foldably joined to longitudinal opposing edges of the side walls and the opposing end walls are foldably joined to transverse opposing edges of the side walls. The opposing top and bottom walls, opposing end walls, and opposing side walls all cooperate with one another to form the container. One of the opposing end walls comprises at least one pour spout that is defined by a dispensing opening and a tab that is integrally formed on one of the opposing end wall, and a generally U-shaped indentation is formed on one of the opposing end walls to receive the tab therein. The tab is adapted to be moved between an open position and a closed position.

One more aspect of the present invention relates to a paperboard blank for making a container having opposing top and bottom walls, opposing end walls, and opposing side walls. The blank comprises two side panels spaced apart from one another by a top wall. A bottom panel is extended from a longitudinal side of one of the two side panels. A glue flap being is extended from a longitudinal side of the bottom panel, the glue flap is glued to the longitudinal side of one of the side panels when the blank is in the folded position. The top wall has a tab at one end and a flap on anther end. Each of the side panels has a pair of transverse end panels which one of the pair of the transverse end panels comprises a generally U-shaped cut lines, a straight cut line, and a generally U-shaped indentation. Another one of the pair of the transverse end panels comprises a generally V-shaped cut out and a slot wherein the V-shaped cut out and a slot are configured to cooperate with the U-shaped cut lines, the straight cut line, the generally U-shaped indentation, and the tab to form a pour spout when the blank is constructed to make the container.

BRIEF DESCRIPTION OF THE DRAWINGS

A full understanding of the invention can be gained from the following description of the preferred embodiments when read in conjunction with the accompanying drawings in which.

DETAIL DESCRIPTION OF THE PREFERRED EMBODIMENTS

Figure 1:
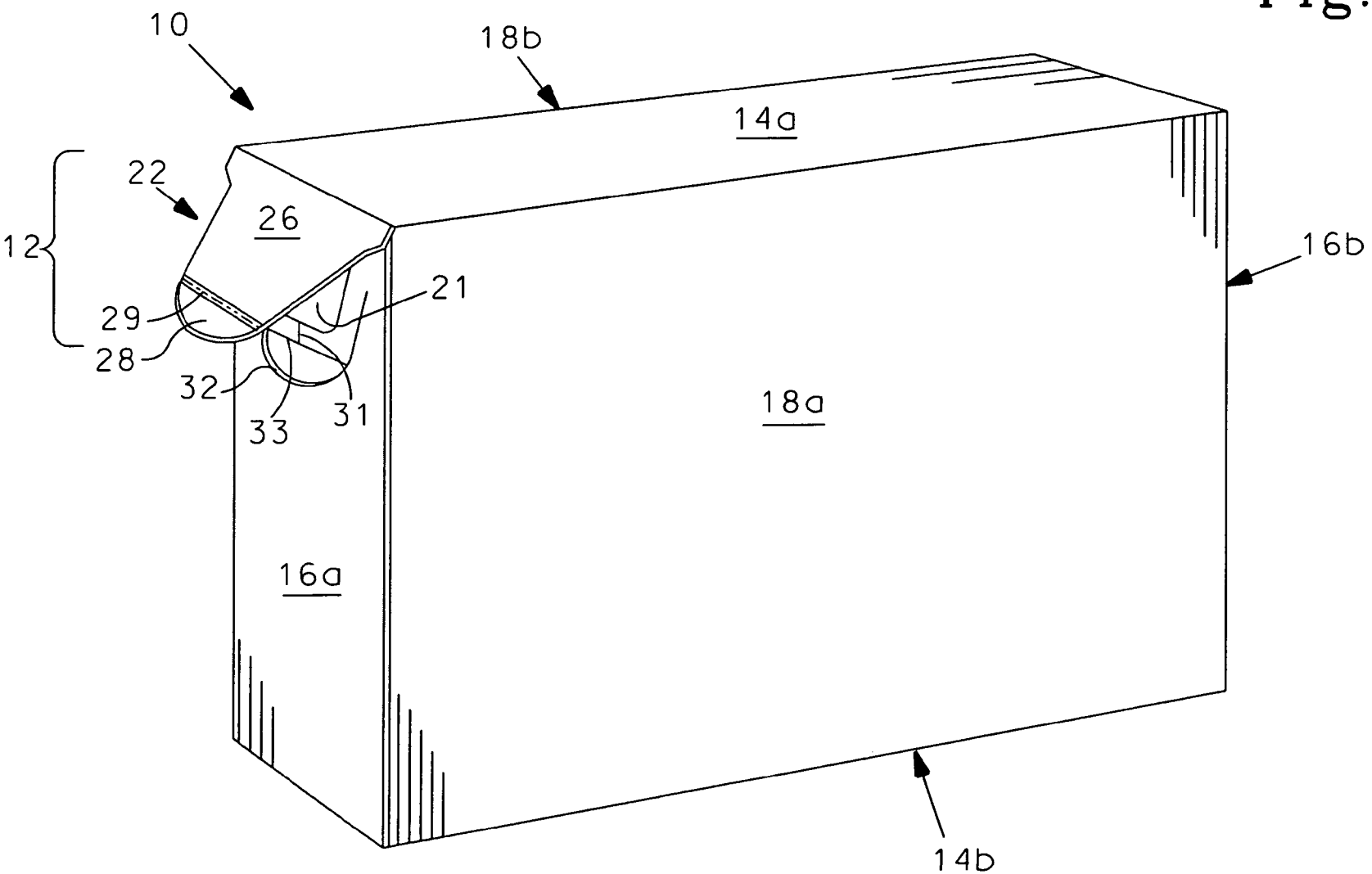
FIG. 1 is a perspective view of a container having an integrally formed pour spout in an open position in accordance to a preferred embodiment of the present invention.
Figure 2:
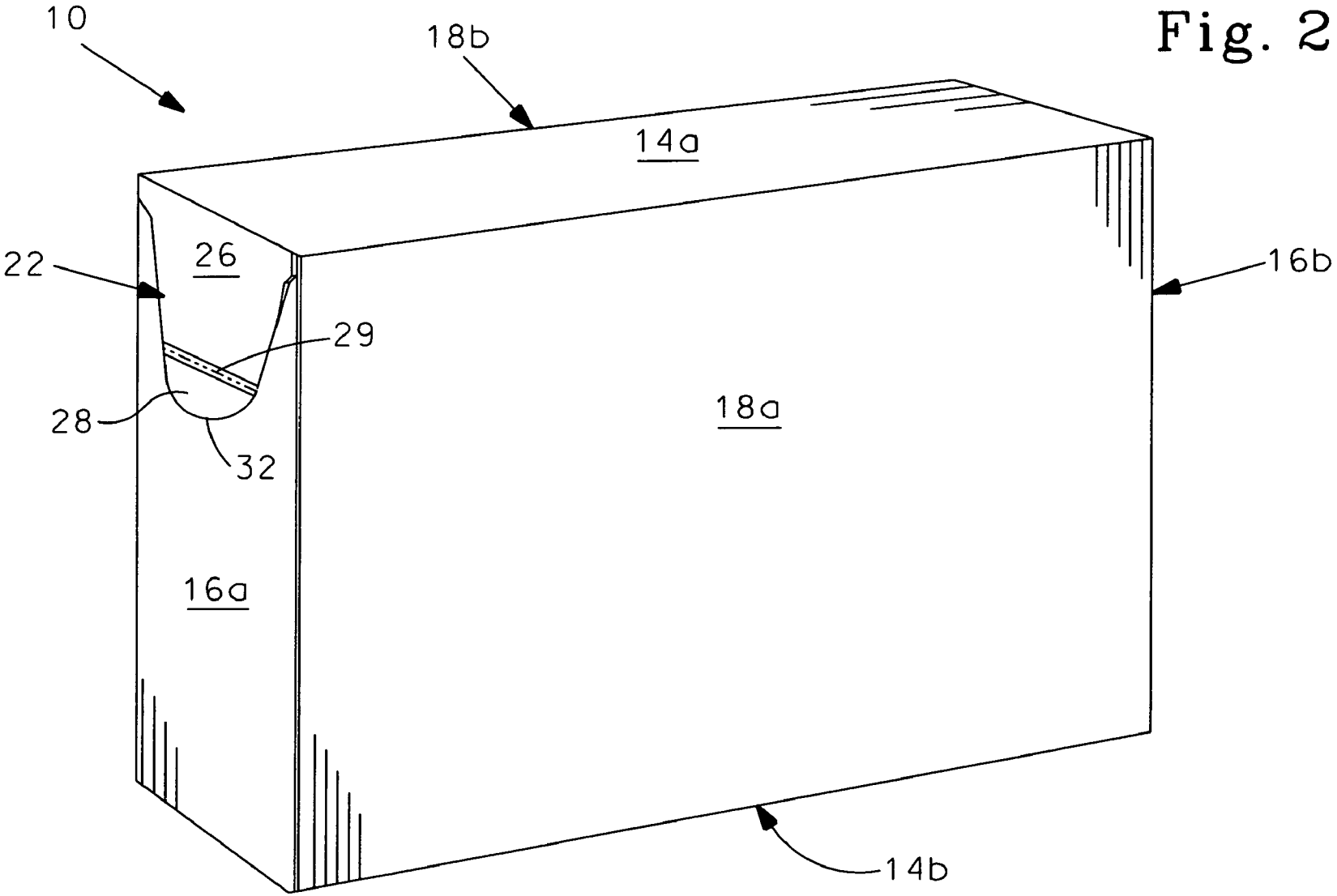
FIG. 2 is a perspective view of the container shown in FIG. 1, illustrating the container in a closed position.

FIG. 1 is a perspective view of a container 10 having an integrally formed pour spout 12, illustrating the pour spout 12 in an open position in accordance to a preferred embodiment of the present invention. The container 10 comprises opposing top and bottom walls 14*a*; 14*b*, opposite end walls 16*a*, 16*b*, and opposite side walls 18*a*, 18*b*. The opposing top and bottom walls 14*a*, 14*b* are spaced apart from one another by the opposite end walls 16*a*, 16*b* and the opposite side walls 18*a*, 18*b*. The opposing top and bottom walls 14*a*, 14*b* are foldably joint to longitudinal opposite edges of the side walls 18*a*, 18*b*, and the end walls 16*a*, 16*b* are foldably joint to transverse opposite edges of the side walls 18*a*, 18*b*. The opposing top and bottom walls 14*a*, 14*b*, the opposite end walls 16*a*, 16*b*, and the opposite side walls 18*a*, 18*b* are all cooperating with one another to form the container 10. The pour spout 12 comprises a dispensing opening 21 and a tab 22 tat is configured to enclose the dispensing opening 21 when the pour spout 12 is in the closed position as depicted in FIG. 2. The tab 22 is formed on the top wall 14*a* for movement between an open dispensing position and a closed position as depicted in respective FIGS. 1 and 2. The tab 22 is integrally extended from the edge of the top wall 14*a* and pivots with respect to the top wall 14*a*. The tab 22 includes a door segment 26 and a locking flap 28 that are defined by a score line 29. The locking flap 28 is inserted into the cut line 33 to hold the door segment 26 of the tab 22 against the opening 21. A generally U-shaped indentation 32 is formed on the end wall 16*a* to receive the tab 22 therein. The tab 22 and the generally U-shaped indentation 32 are substantially the same size and shape and thus, the tab 22 sits in the generally U-shaped indentation 32 so that the tab 22 and surface of the end wall 16*a* are leveled. It should be noted that the depth of the U-shaped indentation 32 corresponds to the thickness of the tab 22. In the open position, the pour spout 12 permits the container 10 to dispense the flowable substance, such as cosmetic or detergent powder or granular material such as sugar or salt contained therein. In the closed position, the pour spout 12 protects the flowable substance of the container 10 from surrounding as best shown in FIG. 2. Depending on the design, the container 10 may have more than one pour spout 12. The container 10 is generally rectangular in shape; however, other geometrical shapes may be used accordingly. The container 10 is preferably made from a flat sheet of heat-resistant laminated linerboard or corrugated paperboard having a laminated linerboard, although any foldable material may be used. The container 10 is constructed from a blank 30 (shown in FIG. 3) which is scored and cut to define a series of foldably interconnected walls and panels as hereinafter described. It is well within the scope of this invention to use any suitable material well known or later developed in the art such as, for example, plastic, foil or the like.

Figure 3:
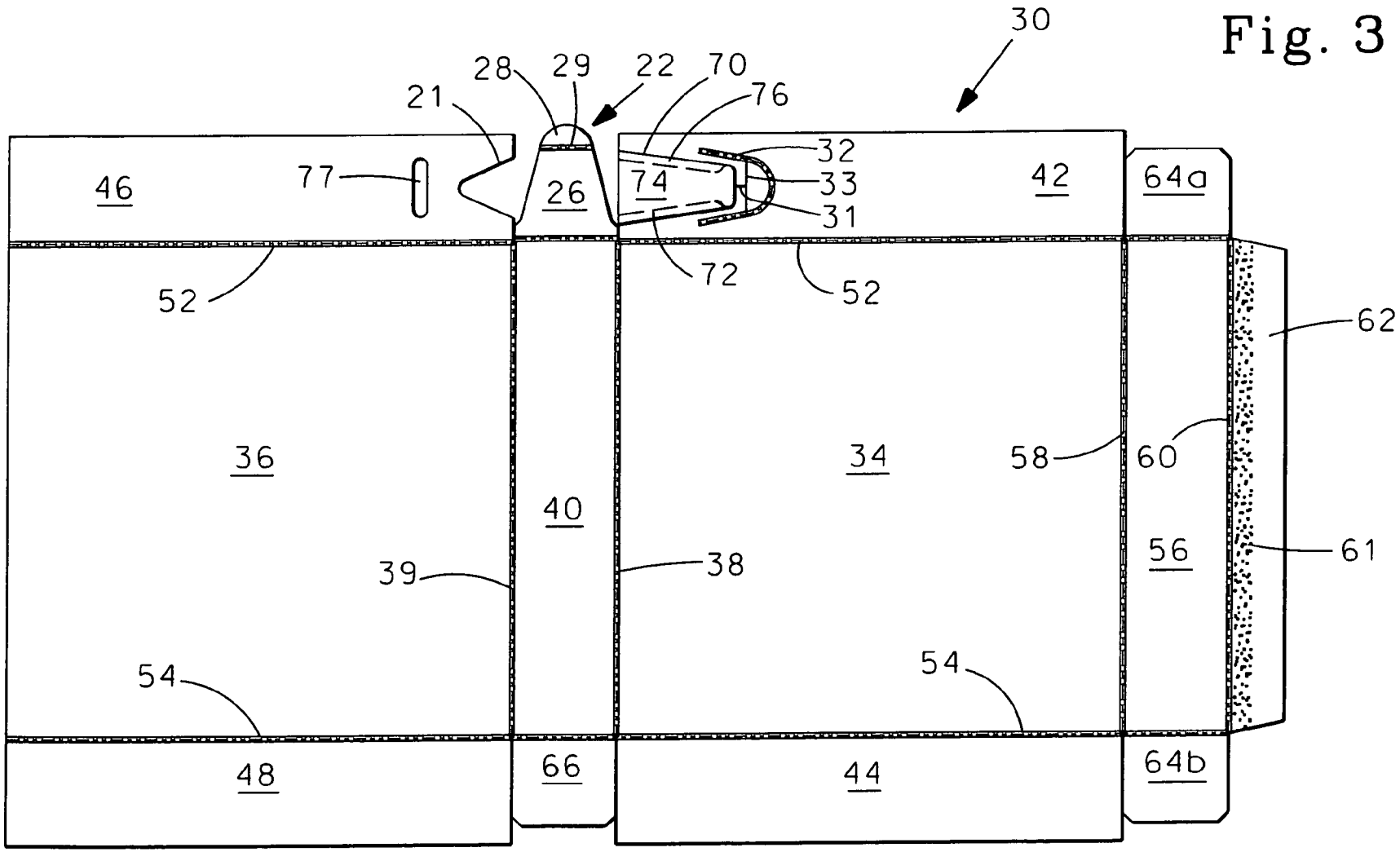
FIG. 3 is a top view of a blank used to construct the container shown in FIG. 1.

FIG. 3 is a top view of the blank 30 used to construct the container 10. The blank 30 is divided into two side panels 34, 36 by two substantially parallel longitudinal fold lines 38, 39 and further divided into four end panels 42, 44, 46, and 48 by two substantially parallel transverse fold lines 52, 54. Top panel 40 is formed by the intersection of the respective two transverse fold lines 52, 54 and respective longitudinal fold lines 38, 39. A bottom panel 56 is extended from the longitudinal edge of the side panel 34 and is defined by intersection of the two substantially parallel longitudinal fold lines 58, 60 and the two substantially parallel transverse fold lines 52, 54 with one another. The bottom panel 56 includes a pair of flaps 64*a*, 64*b* that are defined by intersection of the fold lines 52, 54, and 58. The flaps 64*a*, 64*b* are extended from the transverse end of the bottom wall 14*b*. The bottom panel 56 includes a glue flap 62 that is defined by a fold line 60. The glue flap 62 projects outwardly from the bottom panel 56 and is provided with a quantity of adhesive 61 thereon for properly securing the two side panels 34, 36, and top panel 40 to the bottom wall 14*b*. Alternative forms of securing two side panels 34, 36, and top panel 40 to the bottom wall 14*b*, may be used such as by staple, slots and tabs, etc. Opposite transverse ends of the top panel 40 includes a flap 66 and the tab 22. End panels 42, 46 are formed by fold line 52 and extended outwardly from respective panels 34 and 36. Similarly, End panels 44, 48 are formed by fold line 54 and extended outwardly from respective panels 34 and 36.

End panel 42 includes the U-shaped de-embossed or indentation 32 formed therein. Within the area of the U-shaped indentation 32, there are two cut lines 33 and 31. As noted above, the cut line 33 is formed so that the locking flap 28 is inserted therein when the pour spout 12 is In the closed position. The cut line 31 is formed to facilitate the inserting of the locking flap 28 into the cut line 31. The end panel 42 also includes a generally U-shaped cut line 70 formed therein. One end of the U-shaped cut line 70 is in proximity of the cut line 31 and the other end is at one edge of the end panel 42. It should be noted that the U-shaped cut line 70 is penetrated nearly half of the total depth of the thickness of the end panel 42. Another cut line 72 is also formed on the back side of the end panel 42 in a manner that is penetrated nearly half through the thickness of the end panel 42. The formation of the U-shaped cut line 70 and the cut line 72 are advantageous because these cut lines fonts a plug 74 used to seal the opening 21 when the blank 30 is constructed to form the container 10. As will be described in greater detail a layer 76 of the end panel is adhered to the plug 74, such that the layer 76 and the plug 74 moves in tandem with each other.

Figure 4:
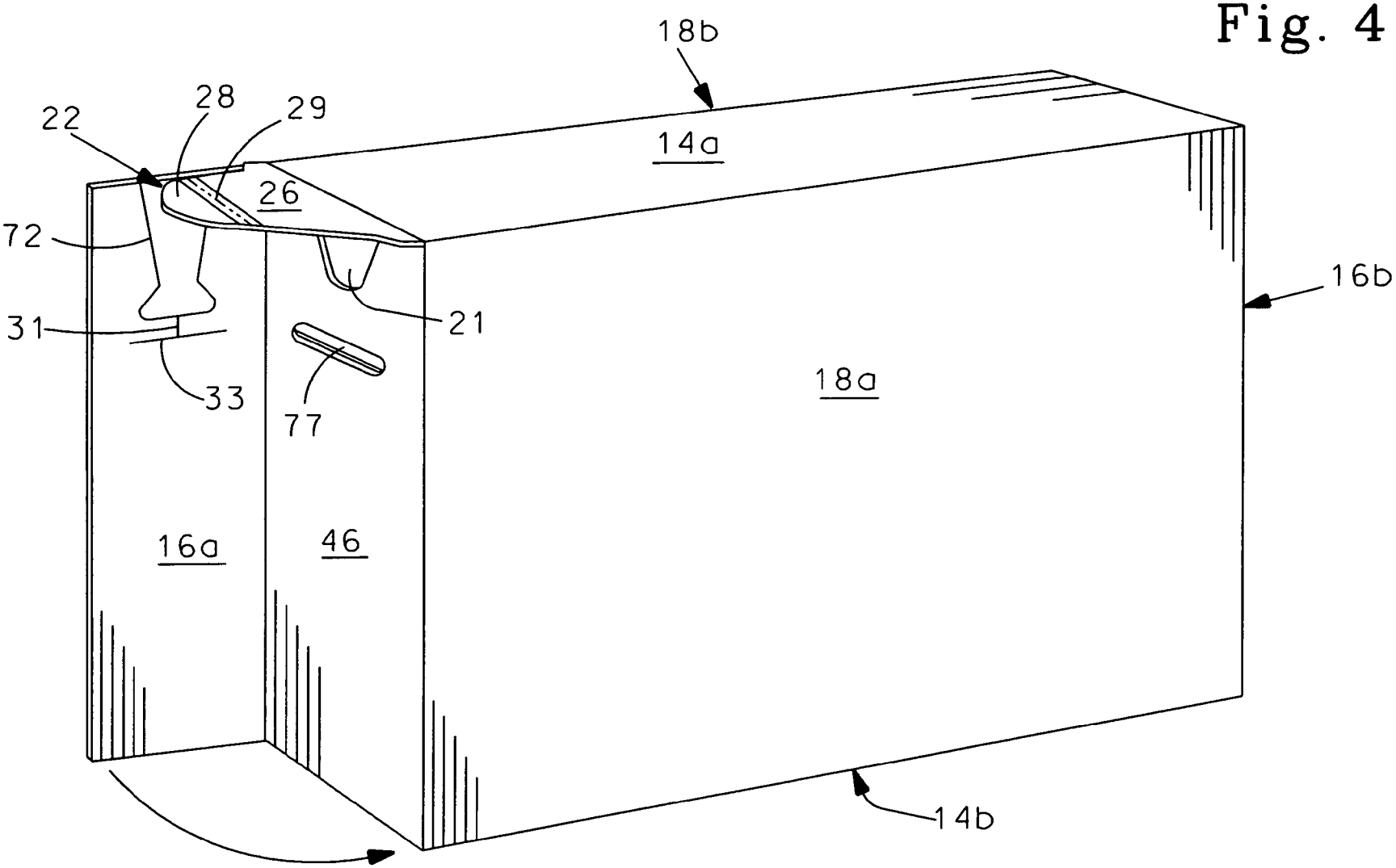
FIG. 4 is a perspective view of the container shown in FIG. 1, illustrating the detail of the pour spout in an unfolded manner.

End panel 46 includes a V-shaped cut out 74 formed therein. The V-shaped cut out 74 will form into the dispensing opening 21 when the blank 30 is constructed to form the container 10. The end panel 46 also includes a slot 77 tat is used to receive the lacking flap 28 therein. As best depicted in FIG. 4, when the blank 30 is in the folded position, the cut line 33 lay over the slot 77 and the locking flap 28 is inserted therein so that the container 10 is in the closed position.

Manual set-up of the container 10 is easily accomplished. First, the blank 30 is folded along the fold lines 38, 39, and 58 and ten the glue flap 62 is preferably glued to the longitudinal side of the panel 36. Next, the flaps 64*b* and 66 are folded inwardly with respect to fold line 54 and the end panels 44 and 48 are folded with respect to fold line 54 onto one another to form the bottom wall 14*b* as shown in FIGS. 1, 2, 4. Then flap 64*a* is tucked in first and second, the panel 46 is folded onto the flap 64*a* with respect to the fold line 52 and third, the panel 42 is folded over the panel 46 and glued thereto. Finally, the tab 22 is preferably hot melted to the panel 42. It should be noted that the tab 22 is hot incited to the U-shaped cut line 70.

Figure 5:
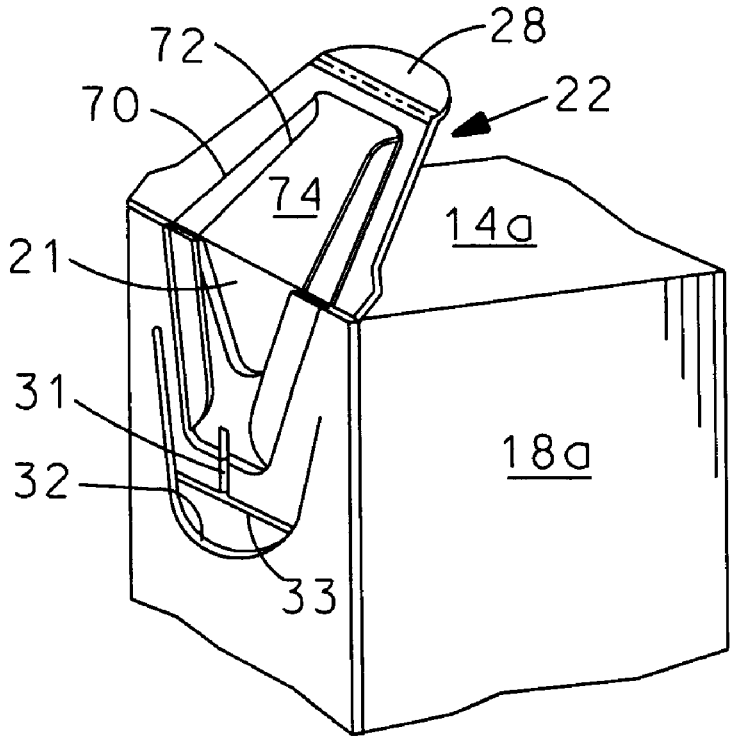
FIG. 5 is a portion of the perspective view of the container shown in FIG. 1, illustrating the detail of the pour spout in the open position.
Figure 6:
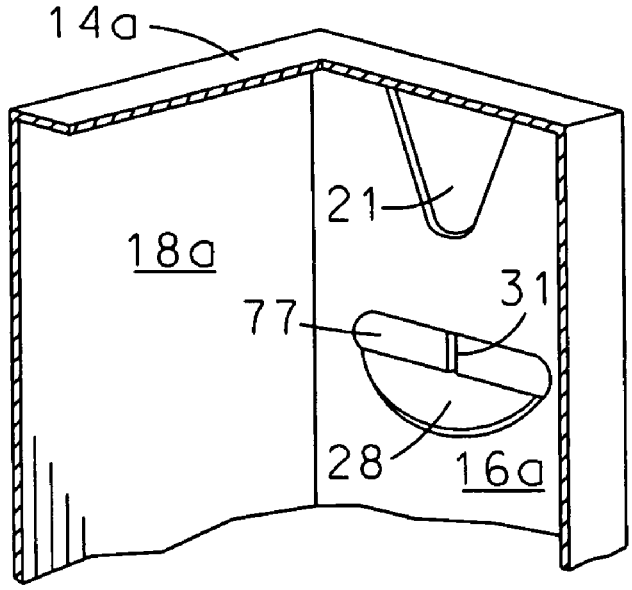
FIG. 6 is a portion of the perspective view of the container shown in FIG. 2, illustrating the pour spout from inside of the container.

Referring to FIGS. 5 and 6, to initially open the pour spout 12, a user pulls outwardly the locking tab 28 and in response to the application of a sufficient amount of opening force, the tab 22 and the layer 76 are forced open. Since the inner surface of the layer 76 is adhered to the plug 74, the layer 76 and the plug 74 move in tandem with each other. During this opening process, the layer 74 breaks free from the surrounding portions of the cut line 70 and, at the same time, the plug 74 breaks free from the panel 42 as best depicted in FIG. 5. After the user dispenses the desired amount of contents from the container 10, the pour spout 12 is enclosed to the closed position shown in FIGS. 2 and 6 by pushing inwardly on the locking tab 28 into the cut line 33.

While the invention has been described with reference to a preferred embodiment it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A container comprising:

opposing top and bottom walls, opposing end walls, and opposing side walls; the opposing top and bottom walls being spaced apart from one another by the opposing end walls and the opposing side walls, the opposing top and bottom walls being foldably joined to longitudinal opposing edges of the side walls, the end walls are foldably joined to transverse opposing edges of the side walls and the opposing top and bottom walls, opposing end walls, and opposing side walls all cooperate with one another to form the container, one of the opposing end walls comprising at least one pour spout being defined by a dispensing opening and a tab, the tab integrally extended from the top wall, and a generally U-shaped indentation formed on said one of the opposing end walls to receive the tab therein, the tab having a plug adapted to seal the dispensing opening, the plug is defined by a generally U-shaped cut line penetrated nearly half through a thickness of the end wall and the plug is formed by detaching the tab from the end wall and wherein the tab adapted to be moved between an open position and a closed position.

2. The container of claim 1 wherein the tab is defined by a door segment and a locking flap.

3. A paperboard blank for making a container having opposing top and bottom walls, opposing end walls, and opposing side walls, the blank comprising:

two side panels spaced apart from one another by a top wall, a bottom panel being extended from a longitudinal side of one of the two side panels, a glue flap being extended from a longitudinal side of the bottom panel, the glue flap being glued to the longitudinal side of one of the side panels when the blank is in the folded position, the top wall having a tab at one end and a flap on anther end, each of the side panels having a pair of transverse end panels, one of the pair of the transverse end panels comprises a generally U-shaped cut line, a straight cut line, and a generally U-shaped indentation, another one of the pair of the transverse end panels comprises a generally V-shaped cut out and a slot wherein the V-shaped cut out and the slot configured to cooperate with the generally U-shaped cut line, the straight cut line, the generally U-shaped indentation, and the tab to form a pour spout when the blank is constructed to make the container.

* * * * *